US005613625A

United States Patent [19]

Specht

[11] Patent Number: 5,613,625

[45] Date of Patent: Mar. 25, 1997

[54] ANTICOUNTERFEIT DEVICE FOR DISPENSER

[75] Inventor: Paul B. Specht, Wilmette, Ill.

[73] Assignee: Waterbury Companies, Inc., Waterbury, Conn.

[21] Appl. No.: 413,129

[22] Filed: Mar. 31, 1995

[51] Int. Cl.[6] ..... B67D 5/06

[52] U.S. Cl. ..... 222/180; 222/325

[58] Field of Search ..... 222/180, 181.3, 222/183, 325

[56] References Cited

U.S. PATENT DOCUMENTS

| | | | |
|---|---|---|---|
| 3,589,563 | 6/1971 | Carragan et al. | 222/70 |
| 4,164,306 | 8/1979 | Perrin | 222/325 |
| 4,830,791 | 5/1989 | Muderlak et al. | 261/26 |
| 4,849,606 | 7/1989 | Martens, III et al. | 219/271 |
| 4,931,224 | 6/1990 | Holzner, Sr. | 261/30 |
| 5,016,781 | 5/1991 | Ten Wolde | 222/325 |
| 5,111,477 | 5/1992 | Muderlak | 392/390 |
| 5,175,791 | 12/1992 | Muderlak et al. | 392/390 |
| 5,209,377 | 5/1993 | Steiner et al. | 222/325 |
| 5,370,829 | 12/1994 | Kunze | 261/24 |

*Primary Examiner*—Andres Kashnikow
*Assistant Examiner*—Philippe Derghshani
*Attorney, Agent, or Firm*—St. Onge Steward Johnston & Reens

[57] ABSTRACT

A dispenser having an anticounterfeit device associated therewith is presented. The dispenser includes a housing having a first portion and a second portion, wherein the first and second portions cooperate to form a cavity therebetween, the cavity sized to permit a source of a material to be dispensed to be disposed therein; and a lockout element having a first side and a second side and a width and depth, the lockout element mounted to the first portion of the housing, the lockout element having at least one projection extending from a first side thereof such that, when the second side of the lockout element is mounted to the first portion of the housing, the projection extends into the cavity, wherein the lockout element is mounted to the first portion of the housing in any of a plurality of orientations such that the at least one projection extends into the cavity in any of a plurality of locations depending on the orientation in which the lockout element is mounted to the first portion of the housing.

19 Claims, 2 Drawing Sheets

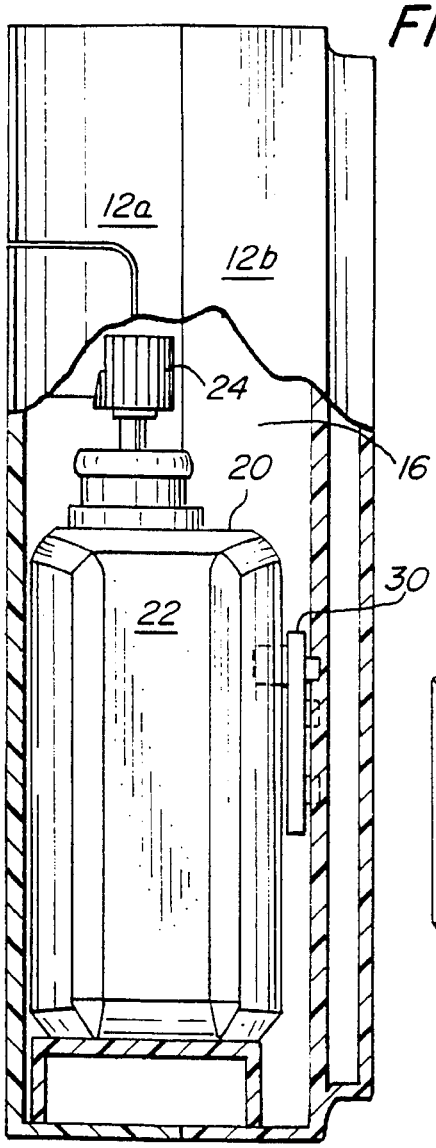
FIG. 5
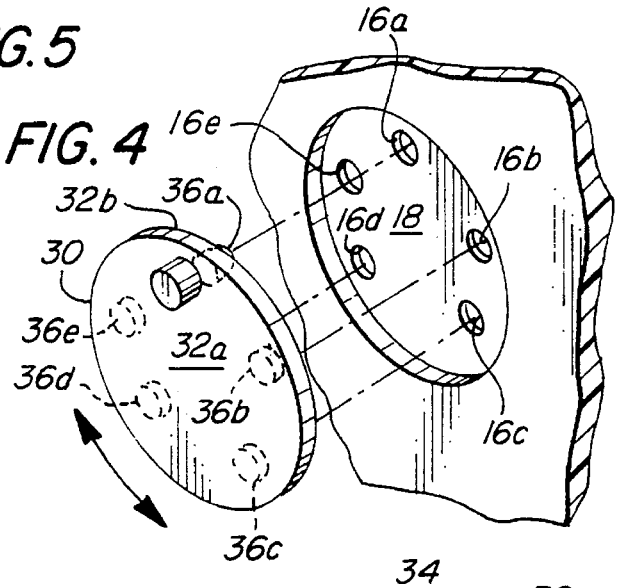
FIG. 4
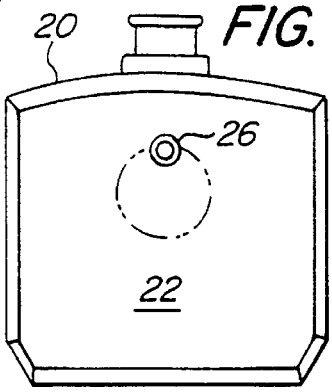
FIG. 7
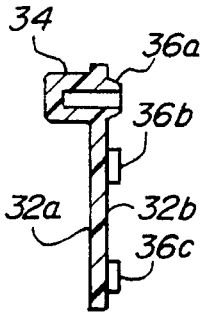
FIG. 6
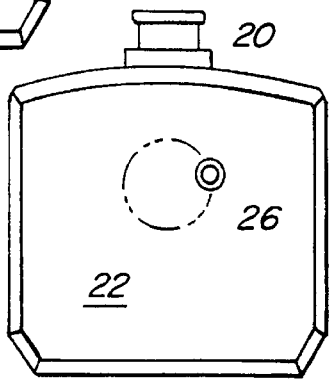
FIG. 8
FIG. 11
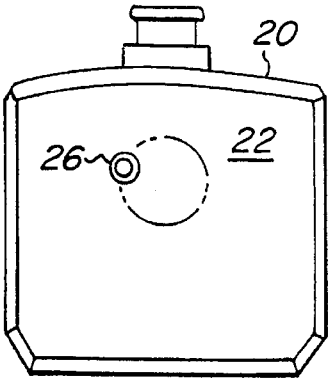
FIG. 10
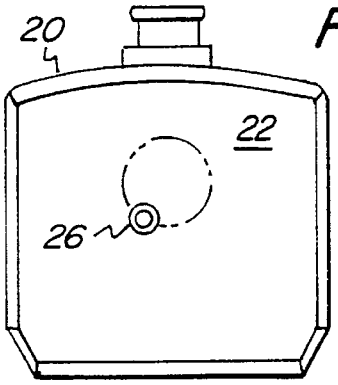
FIG. 9
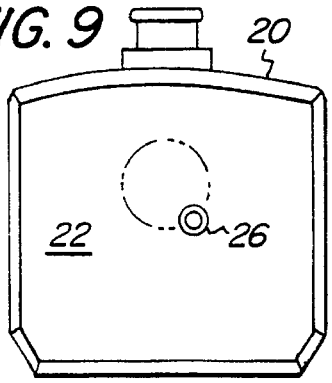

ANTICOUNTERFEIT DEVICE FOR DISPENSER

TECHNICAL FIELD

The present invention relates to an anticounterfeit device for a dispenser. More particularly, the invention relates to a dispenser for an olfactory stimulating material or other material, where the dispenser includes means for preventing the use of counterfeit or bootleg sources of the material to be dispensed.

Many dispensers, especially dispensers for olfactory stimulating materials such as fragrances or deodorizers, include a replaceable source of the olfactory stimulating material such that, when the source is empty, a full replacement can be provided. Such sources come in many forms, including containers, bottles and cartridges (jointly referred to as "cartridge"). However, because the shape of the containers, bottles or cartridges which form the source of the material to be dispensed is often standard, it is possible for the user to insert as a replacement source of material to be dispensed a source not intended to be used with the particular dispenser.

More specifically, a user can inadvertently or otherwise insert a source of a material which is incompatible with or otherwise should not be dispensed by the particular dispenser. For instance, many dispensers use as the source of material to be dispensed an aerosol or pump container which has a reservoir containing an olfactory stimulating material. Depending on the size of the container used, it is foreseeable that an aerosol container containing materials other than the desired olfactory stimulating materials, such as paints or cleaning solutions, could be inadvertently inserted, creating highly undesirable or dangerous results. In addition, from the commercial standpoint, it is desirable that only authorized replacement sources be used in the dispenser.

What is desired, therefore, is a dispenser for a material which includes means for preventing the use of counterfeit or bootleg replacement sources of the material to be dispensed. Such a dispenser has a device which prevents the complete insertion of such counterfeit or bootleg sources. By "counterfeit" or "bootleg" source of the material to be dispensed is meant any source of a material other than the source of the material to be dispensed intended to be used with the dispenser.

BACKGROUND ART

With the growing popularity of the use of automatic air freshening devices in, for instance, restrooms, the need for a device which prevents the use of unauthorized replacements in the dispenser has become more and more acute. One method of providing such a "lockout" system, which is representative of what is conventionally employed, is that disclosed by Holzner, Sr. in U.S. Pat. No. 4,931,224. In Holzner, Sr., a device positioned on the wall of the dispenser has a pair of prongs which extends into the space in which the replacement cartridge is intended. The complimentary cartridge then has a pair of apertures corresponding to the location of the prongs which permit only those cartridges having complementary apertures to be utilized in the subject dispenser.

Unfortunately, the use of the prong device of Holzner, Sr. requires an excessive amount of manual labor in the fabrication of the subject dispenser. This expenditure of manual labor renders the device of Holzner, Sr. far less practical from a commercial standpoint than is desired. The present invention provides a desirably practical anticounterfeit device.

SUMMARY OF THE INVENTION

Accordingly, it is an object of the present invention to provide a dispenser for a material, especially an olfactory stimulating material, which includes a device which permits the use of only authorized sources of the material to be dispensed.

It is another object of the present invention to provide a dispenser having an anticounterfeit device which can be adjusted to permit a plurality of orientations.

It is still another object of the present invention to provide an anticounterfeiting device for a material dispenser which can be securely mounted or adhered to the dispenser to prohibit the use of unauthorized or bootleg replacement sources of the material to be dispensed.

It is a further object of the present invention to provide an anticounterfeiting device for a dispenser, wherein the anticounterfeiting device can be used in a variety of dispenser types.

To overcome the deficiencies of the prior an and to achieve the objects and advantages listed above, Applicant discloses, in a preferred embodiment, a dispenser having an anticounterfeit device, the dispenser including a housing having a front portion and back portion which cooperate to form a cavity therebetween, the cavity being sized to permit a cartridge containing the material to be dispensed therein.

Also included in the dispenser of the present invention is an anticounterfeit device comprising a lockout element mounted to the one of the front portion or back portion of the housing. The lockout element has at least one projection extending therefrom into the cavity formed between the front portion and the back portion of the housing. The lockout element can be mounted to one of the front portion or the back portion of the housing in any of a plurality of orientations such that the projection extends into the cavity in any of a plurality of locations depending on the orientation in which the lockout element is adhered to the front portion or the back portion of the housing.

In a preferred embodiment of the invention, the dispenser also includes a source of the material to be dispensed, which includes a cartridge having a reservoir for the material to be dispensed, the cartridge being sized to fit within the cavity of the housing. The source of material to be dispensed includes at least one lockout-well which is sized such that the projection from the lockout element can fit therein, the lockout well being oriented on the source of material to be dispensed such that the projection extends into the lockout well, to thusly permit the source of material to be dispensed to fit within the cavity.

The present invention is applicable to a variety of dispensers capable of dispensing a material, especially an olfactory stimulating material. For instance, one such dispenser is a fan driven dispenser, wherein the olfactory stimulating material is in liquid form, or incorporated in a gel. One example of such a dispenser is that disclosed by Kunze in U.S. Pat. No. 5,370,829, which is hereby incorporated by reference herein. The fan creates air flow across the surface of the liquid or gel, causing vaporization and dispersal of the olfactory stimulating material.

More particularly, such a dispenser has a housing containing at least one inlet vent and at least one outlet vent, a fan operated by, e.g., a battery for directing air into and out of the vents, and a source of an olfactory stimulating material in the form of a cartridge containing a vaporizable substance (i.e., a gel incorporating the olfactory stimulating material), which is vaporized by the airflow generated by the fan and directed into the atmosphere through the outlet vents. Due to the arrangement of the fan, vents and cartridge, the air flow is across the surface of the vaporizable substance, which causes dispensing of the olfactory stimulating material.

Another dispenser applicable for use in the present invention is a dispenser which actuates a pump or aerosol cartridge, i.e., dispensers wherein the material to be dispensed is contained in a cartridge which is actuated by depressing a spray head. Although pump cartridges can technically be defined as aerosols, the two terms are being employed separately to denote non-propellant driven cartridges and propellant driven cartridges, respectively. One such dispenser is disclosed by Carragan and Vecca in U.S. Pat. No. 3,589,563, which is hereby incorporated by reference herein (although it will be noted that the Carragan and Vecca patent is written in terms of aerosol cartridges, the same principles will apply to non-propellant driven pump cartridges). Briefly, an actuating arm rides on a cam. When the radius of the cam decreases, the arm is forced downward, where it contacts the spray head of the aerosol (or pump) cartridge, causing dispersal of the olfactory stimulating liquid.

A third dispenser which can be used with the present invention is one in which the material to be dispensed is present in a solid block of material. When heat is applied to the block, the material to be dispensed is vaporized and dispersed to the environment.

Whether the dispenser is a fan dispenser, or an aerosol or pump dispenser (i.e., a spray head dispenser), or another type of dispenser, the dispenser comprises a housing which has an internal cavity sized to permit insertion of a source of a material to be dispensed (i.e., the cartridge in a fan dispenser and an aerosol or pump cartridge in a spray head dispenser) and a dispensing means (i.e., the fan in a fan dispenser or the actuator/cam assembly in a spray head dispenser).

The dispenser of the present invention also includes control means for the dispensing means, to control the frequency and/or intensity of dispensing. For instance, the control means can comprise a clock which is operatively connected to the dispensing means, such that the clock can be set for desired hours of operation (for instance, 8:00 a.m. to 6:00 p.m.), wherein the dispenser is active and dispensing during those hours of operation. In the alternative, the control means can comprise a light sensor, such as a cadmium sulfide photocell, which is operatively connected to the dispensing means such that the dispensing means is active and operating during periods when the ambient light is above or below certain levels.

The control means can also provide control over the frequency or intensity of dispensing. For instance, the control means can include a timer circuit, such as a timer driven off the clock used to set the hours of operation. The timer circuit is operatively connected to the dispensing means such that frequency of dispensing can be controlled. The timer can have a variety of settings which control frequency of dispensing. For example, a first setting for the timer circuit may cause the actuator in a spray head dispenser to dispense every fifteen minutes, whereas a second setting may cause the actuator to dispense every ten minutes and a third setting may cause the actuator to dispense every five minutes. Likewise, the control means can control the intensity (i.e., speed of operation) of the fan in a fan dispenser.

The lockout element used with the dispenser of the present invention preferably comprises an element having a first and a second side as well as a width and a depth. The projection of the lockout element extends from a first side thereof such that when the second side of the lockout element is mounted, most preferably permanently mounted, to either the front portion or the back portion of the housing, the projection extends into the cavity. It is also possible that the lockout element has more than one projection extending therefrom, in which case the cartridge containing the material to be dispensed must have an equal number of wells complementary to the projections of the lockout element.

The lockout element is capable of being oriented when adhered on the front portion or the back portion of the housing in any of a variety of orientations, each orientation providing the projection extending into the cavity in a different location in the cavity. For instance, the lockout element can be capable of being rotated into any of a variety of positions such that, in each position, the projection extends into the cavity in a different location. The source of material to be dispensed would thereby have to have a lockout well located in a complementary position for that particular orientation of the lockout element, to permit the source of material to be dispensed to be adequately inserted in the housing.

In another preferred embodiment of the present invention, the portion of the housing onto which the lockout element is mounted has a recess which has a width and depth at least equal to that of the lockout element, such that the lockout element will fit within the recess and therefore lie flush with the wall of the housing, with the exception of the projection. Preferably, the lockout element also has one or more tabs extending from the second side thereof which can fit into complementary anchor wells of the portion of the housing onto which the lockout element is mounted, to facilitate the secure adhesion of the lockout element to the first portion of the housing. Of course, it will be recognized that it is equally advantageous to have the tabs on the housing and the anchor wells on the lockout element.

These and other objects will become more readily apparent when the following description is read in conjunction with the accompanying drawings.

BRIEF DESCRIPTION OF THE DRAWINGS

FIG. 4 is a partially broken away exploded perspective view of the dispenser of FIG. 1, showing the lockout element fitting into a recess in the back portion of the housing of the dispenser of FIG. 1;

FIG. 5 is a partially broken away side plan view of the dispenser of FIG. 1, showing the positioning of the source of material to be dispensed in the cavity thereof, and the projection of the lockout element in phantom;

FIG. 6 is a cross-sectional view of the lockout element of the dispenser of FIG. 1; and FIGS. 7–11 are each rear plan views of the source of material to be dispensed, showing the lockout well into which the projection of the lockout element fits, in a plurality of orientations.

DETAILED DESCRIPTION OF THE DRAWINGS

Figure 2:
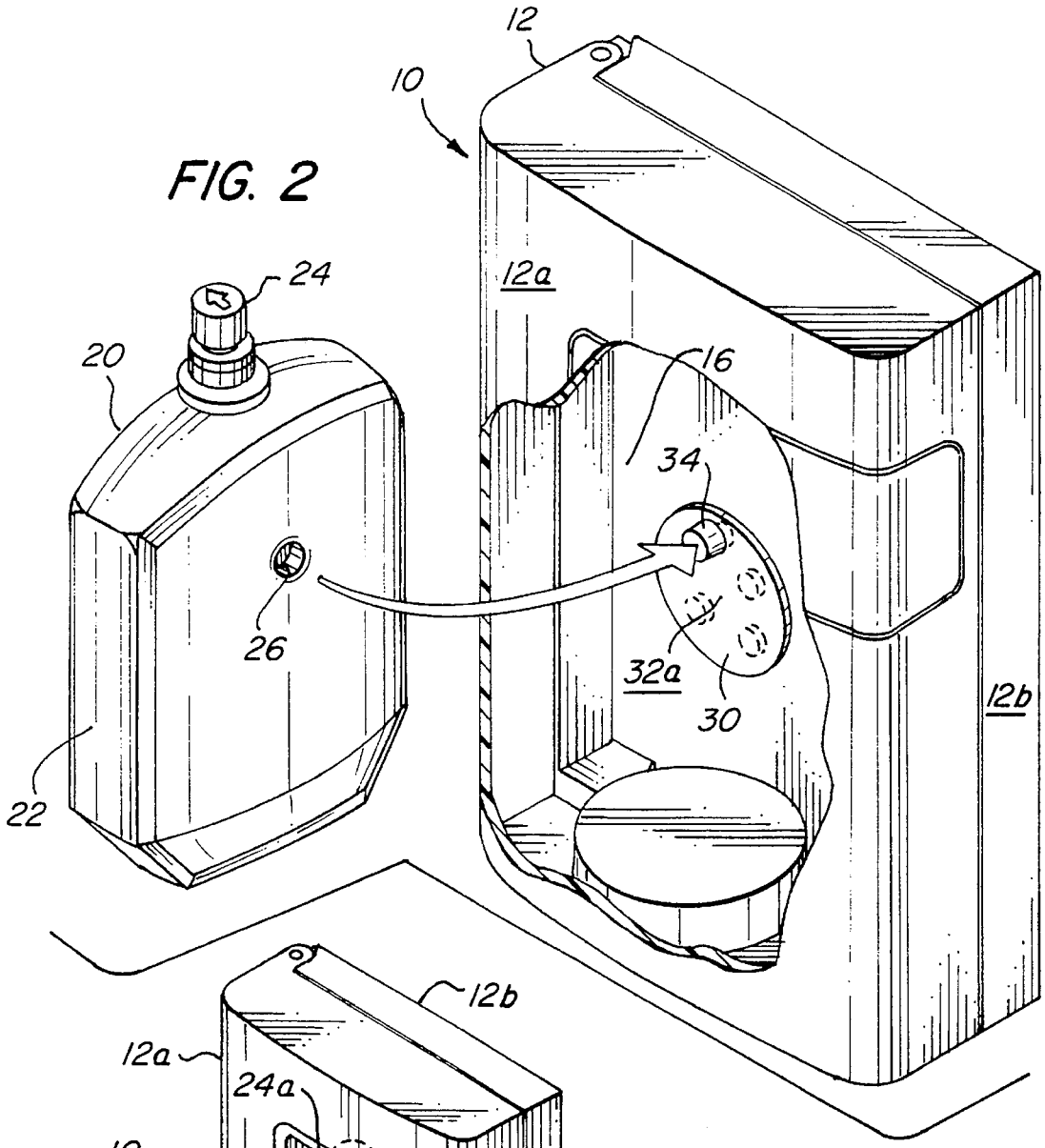
FIG. 2 is a partially broken away perspective view of the dispenser of FIG. 1, having a lockout element and illustrating the positioning of the source of material to be dispensed therein.
Figure 1:
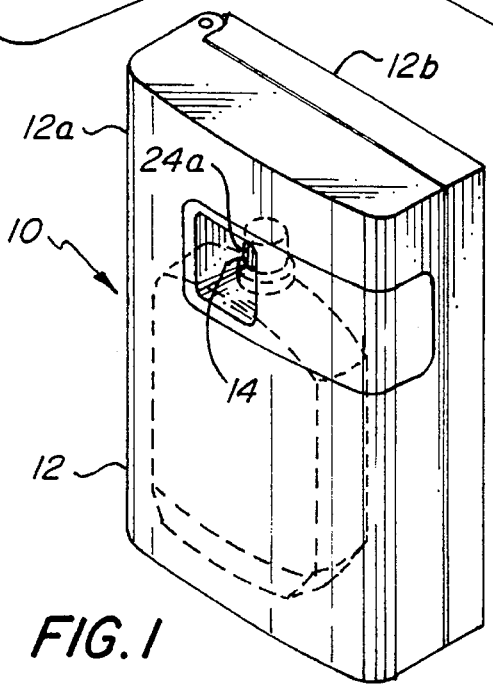
FIG. 1 is a perspective view of a dispenser constructed in accordance with the present invention, having a source of material to be dispensed shown in phantom.

Referring to FIGS. 1 and 2, a dispenser, constructed in accordance with the present invention, is shown and generally designated by the reference numeral 10. It should be noted that for the sake of clarity, all the components and parts of dispenser 10 may not be shown and/or marked in all the drawings. Also, as used in this description, the terms "up", "down", "front", "back", "top", "bottom", etc. refer to dispenser 10 when in the orientation illustrated in FIGS. 1 and 2. It will be understood, however, that dispenser 10 may be in any of various orientations when in use, and, as such, the orientation illustrated in FIGS. 1 and 2 is not necessary for operability.

Although this description is written in terms of dispensing an olfactory stimulating material, such description is for convenience only. It should be understood that the present invention applies to a dispenser for any material (whether it be dispensed in liquid form per se, or carried in a gel or like material), such as paint, cleaning materials, an antistatic agent, etc. By "olfactory stimulating material" is meant any material which affects the olfactory response to the environment in a room or other space. Included within the term "olfactory stimulating material" are fragrances, perfumes, deodorizing components, etc. Such materials are generally liquid in active form, i.e., when vaporized in the atmosphere to provide olfactory stimulating effects; however, when present in dispenser 10, the olfactory stimulating material may be present incorporated in a carrier medium such as a gel.

Dispenser 10 generally comprises a housing 12. Housing 12 comprises a vent 14 through which liquid to be dispensed can be expelled into the environment surrounding housing 12. Housing 12 can be made of any suitable material, such as a plastic, like low- or high-density polyethylene, polypropylene or medium impact styrene, and can be made by any suitable method, such as by injection molding.

Housing 12 includes an internal cavity 16 defined by a front portion 12*a* and a back portion 12*b* of housing 12. Housing 12 can stand freely on a surface, or it can be mounted on a surface, such as a wall or other vertical surface. Desirably, back portion 12*b* is hingeably secured to front portion 12*a*, to permit opening of housing 12, and insertion of a source of olfactory stimulating material into cavity 16.

Cavity 16 of housing 12 is sized to permit insertion of an appropriate source of olfactory stimulating material therein. For instance, a spray head cartridge 20 can be inserted into cavity 16. Spray head cartridge 20 comprises any source of olfactory stimulating material which includes a reservoir 22 which contains the olfactory stimulating material to be dispensed, and means for dispensing the olfactory stimulating material by depressing a spray head 24. A typical spray head cartridge is one which includes a propellant material with the olfactory stimulating material in reservoir 22 under pressure such that depressing spray head 24 forces both the olfactory stimulating material and propellant through a spray head orifice 24*a* and out vent 14. Another typical spray head cartridge 20 is one in which depressing spray head 24 causes olfactory stimulating material to be mechanically expelled or pumped through spray head orifice 24*a* and out vent 14. Both types of spray head cartridges 20 are known in the art.

Dispenser 10 also comprises a dispensing means (not shown), which functions to actuate spray head dispenser 20 such that olfactory stimulating material is automatically dispensed from dispenser 10. A typical dispensing means is disclosed by Carragan and Vecca in U.S. Pat. No. 3,589,563.

In addition to dispensing means, dispenser 10 can also comprise a control means (not shown), which controls when the dispensing means causes dispensing of the olfactory stimulating material. Suitable control means are known in the art.

Housing 12 further comprises lockout element 30 which is mounted, most preferably permanently mounted, on one of front portion 12*a* or back portion 12*b* of housing 12. Generally, lockout element 30 is disposed on back portion 12*b*, although doing so is not critical (for ease of understanding, however, this description is written in terms of lockout element 30 mounted on back portion 12*b* only). Lockout element 30 comprises base 32 and at least one projection 34 extending from base 32 on a first side 32*a* thereof. In this manner, when a second side 32*b* of lockout element 30 is adhered to, e.g., back portion 12*b* of housing 12, projection 34 extends into cavity 16.

Figure 3:
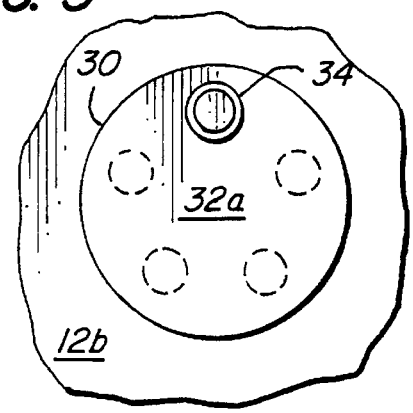
FIG. 3 is a front plan view of the lockout element of the dispenser of FIG. 1.

Depending on the orientation of lockout element 30 when adhered to back portion 12*b*, projection 34 extends into cavity 16 in any of a plurality of locations. For instance, if lockout element 30 is rotated in 72° increments, projection 34 will extend into cavity 16 in any of five different locations, illustrated in phantom in FIG. 3. Likewise, if lockout element comprises more than one projection 34, but less than five, the location of the projections will vary depending on the rotational position of lockout element 30. Similarly, rotation in increments other than 72° will provide alternative locations for projection 34 or a plurality of projections from lockout element 30.

Most desirably, back portion 12*b* has a recess 18 therein which has a depth and width which is at least equal to, and generally greater than, the depth and width of lockout element 30, such that lockout element 30 can fit within recess 18 so that lockout element 30 lies flush with back portion 12*b* (except for projection 34 which extends into cavity 16), as illustrated in FIG. 4. Moreover, back portion 12*b* can comprise anchor wells 16*a–e* which cooperate with tabs 36*a–e* extending from second side 32*a* of lockout element 30, to facilitate anchoring of lockout element 30 on back portion 12*b*. Lockout element 30 can be mounted to back portion 12*b* by any suitable means, such as by use of adhesives or sonic welding.

Because of the positioning of lockout element 30 such that projection 34 extends into cavity 16, it is necessary that cartridge 20 have a lockout well 26 sized such that projection 34 can fit therein. Lockout well 26 must be located on cartridge 20 such that it is in the location in cavity 16 in which projection 34 extends, or else cartridge 20 will not fit adequately within cavity 16 to permit operation of dispenser 10. Accordingly, only a cartridge 20 having lockout well 26 in the appropriate position can be fully inserted into cavity 16. Likewise, if lockout element 30 has more than one projection 34 therefrom, cartridge 20 must have more than one lockout well 26 such that each projection 34 from lockout element 30 will fit within a lockout well 26 on cartridge 20.

FIGS. 7–11 illustrate the positioning of lockout well 26 on cartridge 20, when lockout element 30 is capable of being rotated in increments of 72° to provide five locations in cavity 16 in which projection 34 can extend. It will be recognized, of course, that the rotation of lockout element 30 in differing increments will provide more or fewer potential positions for lockout well 26.

By the provision of lockout element 30 on back portion 12*b*, only those cartridges 20 having the appropriately positioned lockout well 26 are capable of being used with dispenser 10. In this way, unauthorized or bootleg replacements for the source of liquid to be dispensed by dispenser 10 cannot be effectively employed.

It should be understood by those skilled in the art that obvious modifications can be made to the present invention without departing from the spirit of the invention. Accordingly, reference should be made primarily to the accompanying claims, rather than the foregoing specification, to determine the scope of the invention.

What is claimed is:

1. A dispenser having an anti-counterfeit device associated therewith, comprising:

a. a housing having a first portion and a second portion, wherein the first and second portions cooperate to form a cavity therebetween, the cavity sized to permit a source of a material to be dispensed to be disposed therein; and b. a lockout element having a first side and a second side and a width and depth, the lockout element mounted to the first portion of the housing, the lockout element having at least one projection extending from a first side thereof such that, when the second side of the lockout element is mounted to the first portion of the housing, the projection extends into the cavity, wherein the lockout element is mounted to the first portion of the housing in any of a plurality of orientations such that the at least one projection extends into the cavity in any of a plurality of locations depending on the orientation in which the lockout element is mounted to the first portion of the housing.

2. The dispenser of claim 1, wherein the source of material to be dispensed comprises a cartridge for an olfactory stimulating material.

3. The dispenser of claim 2, which further comprises a source of an olfactory stimulating material comprising a cartridge having a reservoir for an olfactory stimulating material, wherein the cartridge is sized to fit within the cavity of the housing.

4. The dispenser of claim 3, wherein the cartridge comprises at least one lockout well sized such that the at least one projection of the lockout element can fit therein, the at least one lockout well oriented on the cartridge such that the at least one projection extends into the at least one lockout well when the cartridge is disposed in the cavity of the housing.

5. The dispenser of claim 1, wherein the first portion of the housing has a recess therein, the recess having a width at least equal to the width of the lockout element and the recess having a depth at least equal to the depth of the lockout element.

6. The dispenser of claim 5, wherein the lockout element is mounted to the first portion of the housing in the recess, such that only the projection of the lockout element extends into the cavity.

7. The dispenser of claim 1, wherein the first portion of the housing has at least one anchor well therein, and further wherein the lockout element has at least one anchor tab extending from the second side thereof and sized to fit in the at least one anchor well of the first portion of the housing, the at least one anchor tab of the lockout element cooperating with the at least one anchor well of the first portion of the housing to facilitate mounting of the lockout element on the first portion of the housing.

8. The dispenser of claim 7, wherein the first portion of the housing comprises a plurality of anchor wells and the lockout element comprises a plurality of anchor tabs such that the orientation of the lockout element on the first portion of the housing can be varied based on which anchor tabs of the lockout element cooperate with which anchor wells of the first portion of the housing.

9. The dispenser of claim 1, wherein the lockout element is permanently mounted to the first portion of the housing.

10. The dispenser of claim 9, wherein the lockout element is mounted to the first portion of the housing by an adhesive material or by sonic welding.

11. A dispenser having anti-counterfeit means associated therewith, comprising:

a. a housing which comprises a first portion and a second portion, the first portion and the second portion cooperating to form a cavity therebetween, the cavity sized to permit insertion thereinto of a source of a material to be dispensed, the first portion and the second portion being removably secured to each other at at least one point in order to provide access to the cavity for insertion of a source of material to be dispensed;

b. a lockout element mounted to the first portion of the housing, the lockout element having at least one projection extending therefrom such that the at least one projection extends into the cavity of the housing, wherein the lockout element is mounted on the first portion of the housing in any of a plurality of orientations such that the at least one projection extends into the cavity in any of a plurality of locations depending on the orientation in which the lockout element is mounted on the first portion of the housing; and c. a source of a material to be dispensed which comprises a cartridge having a reservoir for a material to be dispensed, wherein the cartridge is sized to fit within the cavity of the housing, wherein the source of material to be dispensed comprises at least one lockout well sized such that the at least one projection of the lockout element can fit therein, the at least one lockout well oriented on the source of material to be dispensed such that each of the at least one projection extends into one of the at least one lockout well when the source of material to be dispensed is disposed within the cavity of the housing.

12. The dispenser of claim 11, wherein the lockout element has a width and a depth and further wherein first portion of the housing has a recess therein, the recess having a width at least equal to the width of the lockout element and the recess having a depth at least equal to the depth of the lockout element.

13. The dispenser of claim 12, wherein the lockout element is mounted to the first portion of the housing in the recess, such that only the projection of the lockout element extends into the cavity.

14. The dispenser of claim 11 wherein the first portion of the housing has at least one anchor well therein, and further wherein the lockout element has at least one anchor tab extending from a side opposite the side from which the projection extends, the at least one anchor tab sized to fit in the at least one anchor well of the first portion of the housing, the at least one anchor tab of the lockout element cooperating with the at least one anchor well of the first portion of the housing to facilitate mounting of the lockout element on the first portion of the housing.

15. The dispenser of claim 14, wherein the first portion of the housing comprises a plurality of anchor wells and the lockout element comprises a plurality of anchor tabs such that the orientation of the lockout element on the first portion of the housing can be varied based on which anchor tabs of the lockout element cooperate with which anchor wells of the first portion of the housing.

16. The dispenser of claim 11, wherein the lockout element is permanently mounted to the first portion of the housing.

17. The dispenser of claim 16, wherein the lockout element is mounted to the first portion of the housing by an adhesive material or by sonic welding.

18. The dispenser of claim 11, wherein the dispenser comprises a dispenser for an olfactory stimulating material.

19. The dispenser of claim 11, wherein the first portion of the housing is mounted to a surface to thereby mount the dispenser to the surface.

* * * * *